US011120929B2

(12) United States Patent
Pippert

(10) Patent No.: US 11,120,929 B2
(45) Date of Patent: Sep. 14, 2021

(54) SURGE ARRESTER AND METHOD FOR INSTALLING A SURGE ARRESTER

(71) Applicant: SIEMENS AKTIENGESELLSCHAFT, Munich (DE)

(72) Inventor: Erhard Pippert, Dallgow-Doeberitz ot Seeburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/980,580

(22) PCT Filed: Mar. 6, 2019

(86) PCT No.: PCT/EP2019/055544

§ 371 (c)(1),
(2) Date: Sep. 14, 2020

(87) PCT Pub. No.: WO2019/174989

PCT Pub. Date: Sep. 19, 2019

(65) Prior Publication Data

US 2021/0005363 A1 Jan. 7, 2021

(30) Foreign Application Priority Data

Mar. 14, 2018 (DE) ..... 102018203893

(51) Int. Cl.

| | |
|---|---|
| ***H01C 7/12*** | (2006.01) |
| ***H01C 1/02*** | (2006.01) |
| ***H01C 17/00*** | (2006.01) |

(52) U.S. Cl.
CPC ..... *H01C 7/12* (2013.01); *H01C 1/02* (2013.01); *H01C 17/00* (2013.01)

(58) Field of Classification Search
CPC ..... H01C 7/12; H01C 17/00; H01C 1/02
See application file for complete search history.

(56) References Cited

U.S. PATENT DOCUMENTS

| | | | | |
|---|---|---|---|---|
| 5,680,289 | A * | 10/1997 | Robinson | H01C 7/126 338/21 |
| 5,912,611 | A * | 6/1999 | Berggren | H01C 7/12 338/21 |
| 6,777,614 | B1 * | 8/2004 | Suenwoldt | H01C 7/12 174/50 |
| 8,446,703 | B2 | 5/2013 | Klaube et al. | |
| 8,982,526 | B2 * | 3/2015 | Anjiki | H01C 7/10 361/127 |

(Continued)

FOREIGN PATENT DOCUMENTS

| | | | |
|---|---|---|---|
| DE | 202005008111 | U1 | 8/2005 |
| DE | 102005024206 | A1 | 12/2006 |
| DE | 102011088072 | A1 | 6/2013 |

*Primary Examiner* — Kyung S Lee

(74) *Attorney, Agent, or Firm* — Laurence A. Greenberg; Werner H. Stemer; Ralph E. Locher

(57) ABSTRACT

A surge arrester includes a tubular housing and an end fitting which is connected to one end of the housing and on which a column having at least one electrical resistor is disposed. A support abuts the inner surface of the tubular housing in the region of the end fitting. The support has a recess in the longitudinal direction of the surge arrester, into which a pressure device is inserted. A method for installing a surge arrester is also provided.

10 Claims, 3 Drawing Sheets

(56) References Cited

U.S. PATENT DOCUMENTS

| | | | | |
|---|---|---|---|---|
| 9,306,385 | B2 | 4/2016 | Gottschalk et al. | |
| 2008/0088406 | A1* | 4/2008 | Klaube | H01C 7/12 338/21 |
| 2009/0225487 | A1* | 9/2009 | Klaube | H01C 7/12 361/118 |
| 2013/0135783 | A1 | 5/2013 | Saito et al. | |
| 2013/0279059 | A1* | 10/2013 | Anjiki | H01C 7/12 361/127 |

* cited by examiner

SURGE ARRESTER AND METHOD FOR INSTALLING A SURGE ARRESTER

BACKGROUND OF THE INVENTION

Field of the Invention

The invention relates to a surge arrester having a tubular housing, an end fitting which is connected to an end of the housing and on which a column having at least one electrical resistor is disposed, and a support which abuts against an inner surface of the tubular housing in the region of the end fitting. The invention also relates to a method for installing a surge arrester.

Surge arresters are used in the medium voltage and high voltage range in order to divert so-called surge voltages, i.e. voltages well above the nominal voltages provided during operation, safely to ground. This prevents damage to operating means such as transformers, for example. By way of example, a surge arrester for high voltage can be arranged on an overhead line and divert impermissibly high currents to ground in the event of a lightning strike or short circuit.

Surge arresters generally contain so-called variable resistors, i.e. electrical resistors, whereof the electrical resistance value is very high up to a design-dependent threshold voltage and is significantly reduced above the threshold voltage so that the surge arrester becomes a good electrical conductor. These resistors are therefore frequently referred to as so-called "variable resistors". Metal oxide resistors, for example, in disc form are arranged above one another in a housing and connected to the high voltage potential and ground potential at the respective ends of the housing. In this case, the surge arrester is barely conductive in normal operation, so that only a slight leakage current flows to ground. However, a high stray current flows in the event of a fault.

A generic surge arrester is known from document DE 102011088072 A1, in which a tubular housing is configured to be comparatively resistant to bending by way of a support device. The support device has at least one clamping ring, which abuts internally against the housing and is conically formed on the side remote from the housing. A support ring equipped with a matching mating cone is seated on this cone. By displacing the support ring in the longitudinal direction of the tubular housing, a force is transmitted via the two cones to the inner surface of the tubular housing, which is thus mechanically stabilized. For a form-locking engagement between the tubular housing, support ring and adjusting rings, precise matching of the components is advantageous.

SUMMARY OF THE INVENTION

Starting with the known support device, the object of the invention is to provide a support device which provides an improved bending strength for the tubular housing with comparatively high manufacturing tolerances.

The invention achieves this object by a surge arrester having a tubular housing, an end fitting which is connected to an end of the housing and on which a column having at least one electrical resistor is disposed, and a support which abuts against an inner surface of the tubular housing in the region of the end fitting, the support having a recess, in the longitudinal direction of the surge arrester, into which a pressure device is inserted.

The surge arrester according to the invention has the advantage that the support means has, in the longitudinal direction of the surge arrester, a recess which, for example, cuts through the support means completely. By way of example, the support means is, however, formed as an individual hollow cylinder segment or ring segment. If a pressure means is inserted into this recess, a good pressing effect can still be achieved, even with comparatively large deviations of the internal diameter of the tubular housing from the given value. In comparison with the previous method, greater manufacturing tolerances can be compensated, which enables the tubular housing to be produced more cost-effectively than before.

In a preferred embodiment of the inventive surge arrester, the pressure means is formed to be substantially wedge-shaped. This is an advantage since, owing to the insertion depth of the pressure means in the support means, a clamping seat is thus always achieved between the pressure means and the support means on the one hand and the support means and the tubular housing on the other.

In a further preferred embodiment of the inventive surge arrester, the pressure means is arranged in the recess substantially with form locking. This further development has the advantage that the clamping seat between the pressure means and the support means on the one hand and the support means and the tubular housing on the other is realized with form locking. As a result, the mechanical stability of the tubular housing, in particular the bending strength at the end fittings, is reinforced in a manner which is comparatively particularly effective.

In a further preferred embodiment of the inventive surge arrester, the recess has two contact regions with the pressure means, wherein the contact regions each have a guide groove and wherein the pressure means has a respective guide projection on its sides facing the contact regions of the support means, and wherein the guide projections are arranged in the guide grooves. This is an advantage since the pressure means cannot slip out of the support means in the transverse direction of the surge arrester. By way of example, the guide groove can have a triangular or quadrangular cross-section. It is particularly preferred if the guide grooves have a parabolic form. The guide projections in this case are formed in a particularly complementary manner to the guide grooves.

In a further preferred embodiment of the inventive surge arrester, the guide grooves and the guide projections fix the pressure means on the support means in such a way that a substantially cylinder-barrel-shaped outer contour of the pressure means and support means is produced, which is pressed against the inner surface of the tubular housing without damage. This an advantage since simple and secure installation is ensured.

In a further preferred embodiment of the inventive surge arrester, the support means is formed substantially as a hollow cylinder.

In a further preferred embodiment of the inventive surge arrester, the support means has a plurality of hollow cylinder segments, which, in the installed state, form a plurality of recesses for receiving a plurality of pressure means. By way of example, 3 or 4 segments and correspondingly 3 or 4 pressure means can be used. This is advantageous since the hollow cylinder segments in conjunction with the pressure means permit simple and particularly precise adaptation of the support means to the internal diameter of the tubular housing.

In a further preferred embodiment of the inventive surge arrester, the support means forms a ring-shaped step in which the column is received substantially with form locking.

Starting with the known method for installing surge arresters, the object of the invention is to provide a method for installing a surge arrester, which, with relatively high manufacturing tolerances for the tubular housing, enables an improved bending strength.

The invention achieves this object by a method for installing surge arresters which includes placing a support on an inner surface of a tubular housing, and inserting a pressure device into a recess of the support, wherein the insertion takes place in the longitudinal direction of the tubular housing. Preferred embodiments of the inventive method are described as well. In this case, the same advantages as explained at the outset for the inventive surge arrester are realized analogously for the inventive method and its embodiments.

BRIEF DESCRIPTION OF THE SEVERAL VIEWS OF THE DRAWING

To better explain the invention, preferred embodiments are shown in a schematic illustration in the figures.

DETAILED DESCRIPTION OF THE INVENTION

Figure 1:
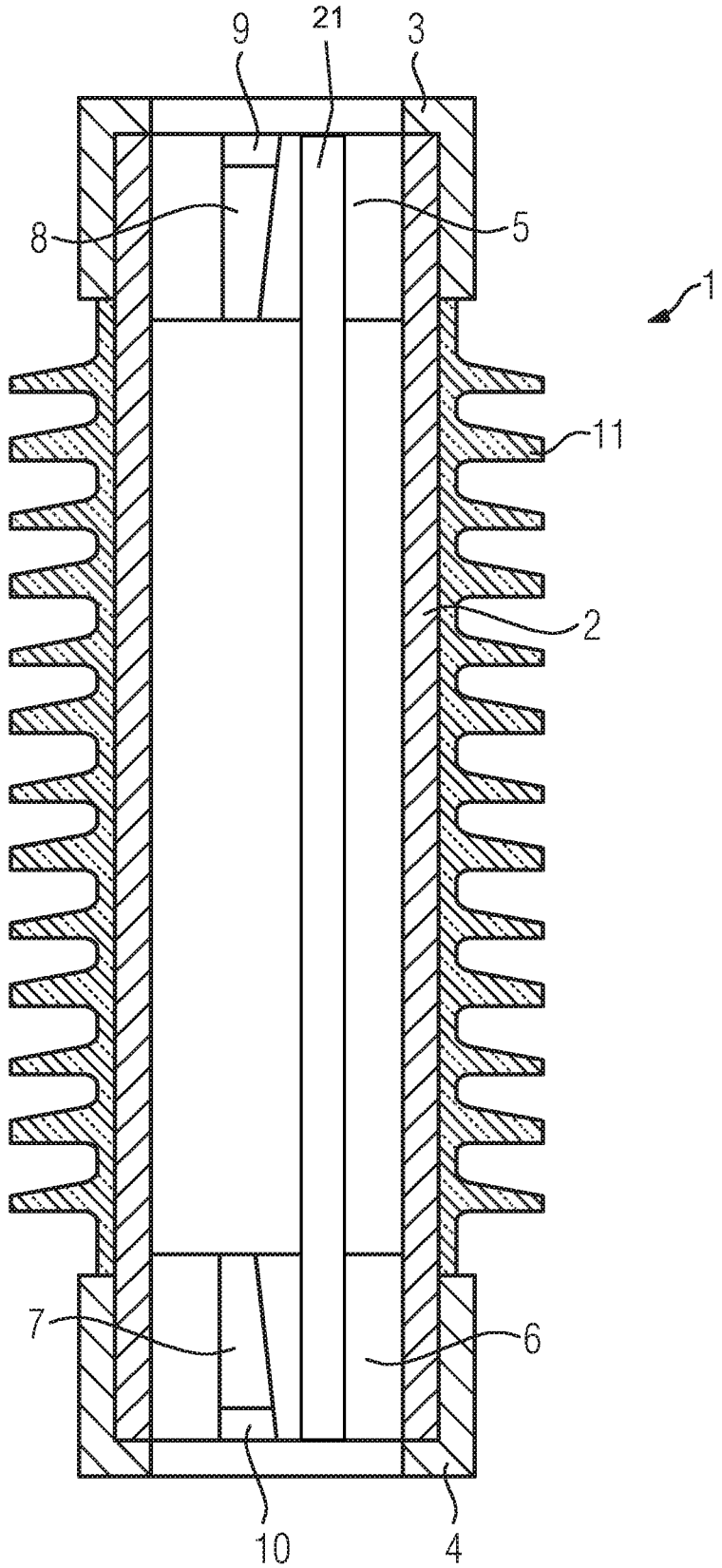
FIG. 1 a first embodiment of an inventive surge arrester.

FIG. 1 shows a first embodiment of an inventive surge arrester 1. The surge arrester 1 has a tubular housing 2 which is adjoined by respective end fittings 3, 4 in the longitudinal direction of the arrester 1. The tubular housing 2 is equipped with an insulation layer 11 of silicone between the end fittings 3, 4. Alternatively, another material, such as ethylene propylene diene M-class rubber (EPDM), for example, can also be used for the insulation layer 11. The insulation layer 11 has shields for extending the creepage path between the end fittings 3, 4. Support means 5, 6 are provided to improve the bending strength of the tubular housing 2 at the end regions. The support means are formed as hollow cylinders with recesses 9, 10. The recesses 9, 10 are formed in a wedge shape. Wedge-shaped pressure means 7, 8 are inserted in the wedge-shaped recesses 9, 10. By displacing the wedge-shaped pressure means 7, 8 in the longitudinal direction of the tubular housing within the recesses 9, 10, the support means 5, 6 can be spread apart and thereby pressed against the inner surface of the tubular housing. This pressing action brings about a reinforcement of the housing in the region of the end fittings and therefore an increased bending strength in this region. In this example, the wedge-shaped recesses are created in such a way that they face the respective end fitting 3, 4 with their wider end.

Figure 2:
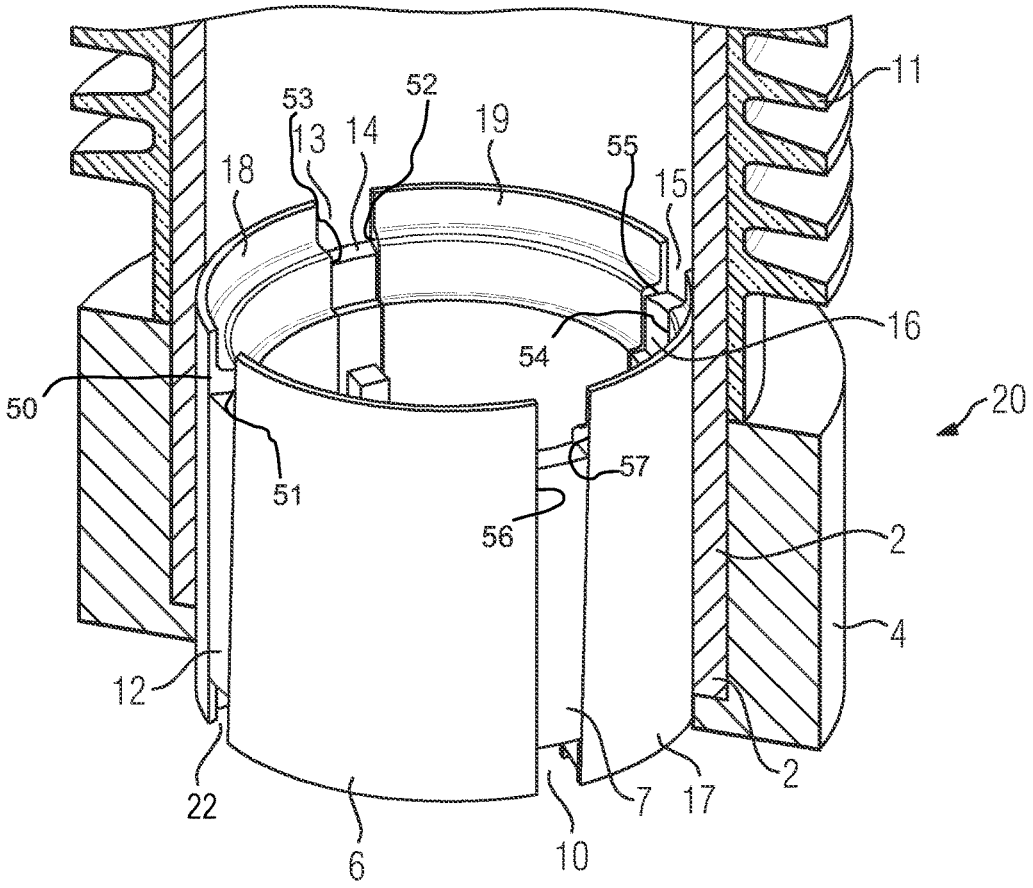
FIG. 2 a first detailed view of a second embodiment of an inventive surge arrester, and FIG. 3 a cross-section of the second embodiment according to FIG. 2, and FIG. 4 a second detailed view of the second embodiment according to FIG. 2, and FIG. 5 a third detailed view of the second embodiment according to FIG. 2.

FIG. 2 shows a first detailed view 20 of a second embodiment of the inventive surge arrester. The support means in this embodiment is formed by four hollow cylinder segments 6, 17, 18, 19, which form wedge-shaped recesses 10, 22, 13, 15. Wedge-shaped pressure means 7, 12, 13, 16 are inserted into these wedge-shaped recesses 10, 22, 13, 15 with form locking and bring about a pressing action against the tubular housing 2. In this case, the wedge-shaped recesses in this embodiment face the end fittings 3, 4 with their narrower end.

Figure 3:
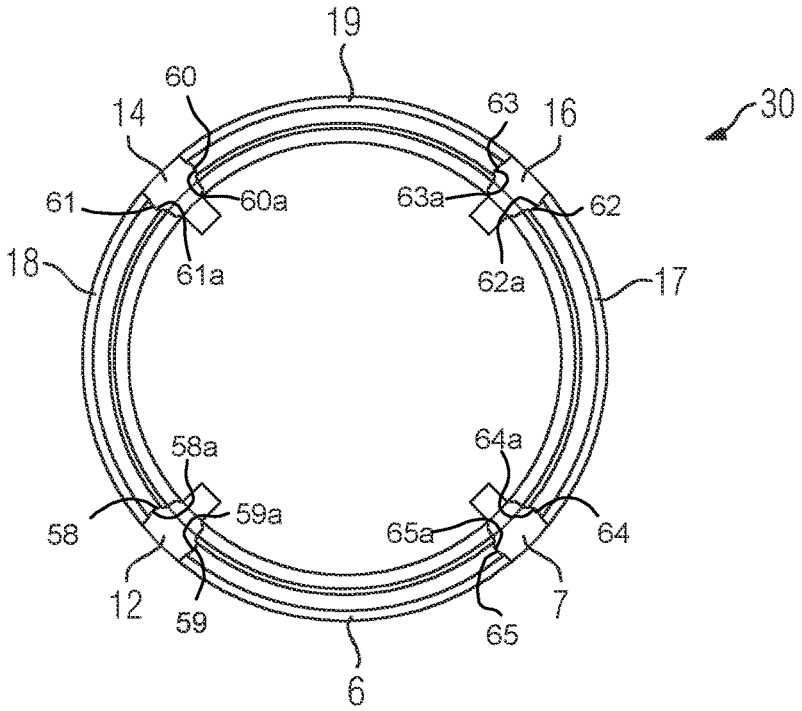

FIG. 3 shows a cross-section 30 of the embodiment 20 according to FIG. 2. The hollow cylinder segments 6, 17, 18, 19 each form two contact regions 50-57 with the pressure means 7, 12, 14, 16 in their recesses. These contact regions 50-57 each have a guide groove 58-65, which is formed to be parabolically rounded in this example. The parabolic form is simple to manufacture and offers good slip resistance. The pressure means 7, 12, 14, 16 each have, at their sides facing the contact regions 50-57, a guide projection **58*a*-65*a* which is arranged in the respective guide groove 58-65**. The interaction between the guide grooves and guide projections means that the pressure means cannot slip out of the hollow cylinder segments in the transverse direction. The pressure means and the hollow cylinder segments form a substantially cylinder-barrel-shaped outer contour of the pressure means and support means, which can be pressed against the inner surface of the tubular housing without damage.

Figure 4:
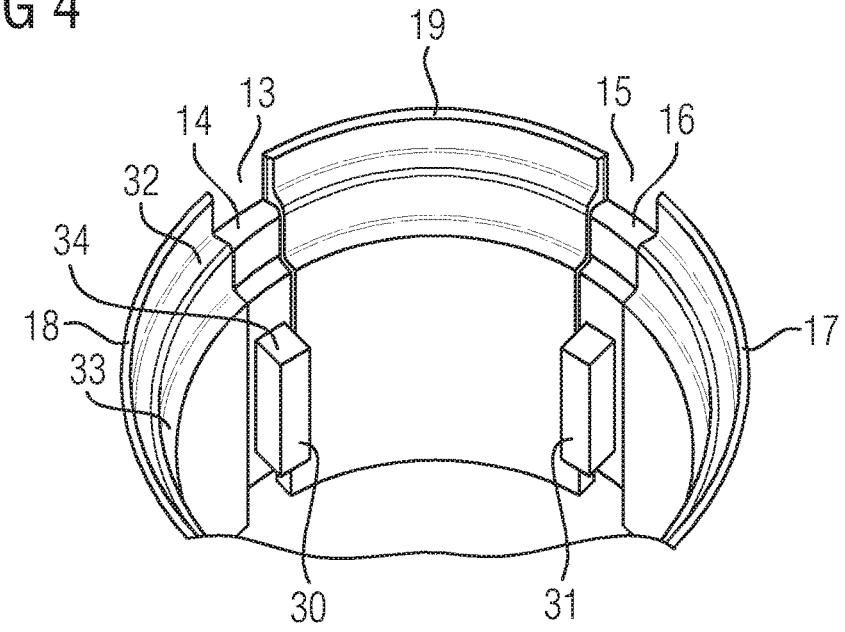
Figure 5:
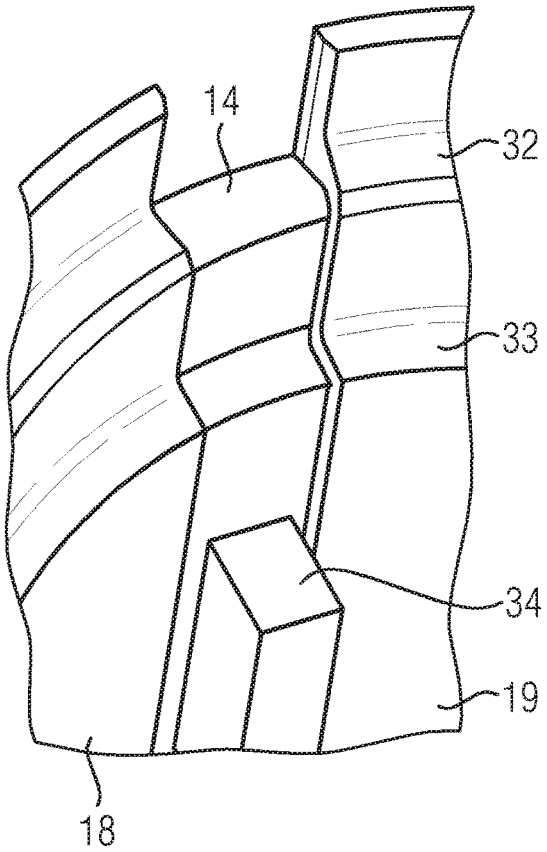

FIGS. 4 and 5 shows a second and a third detailed view of the second embodiment. In this case, it can be seen that the hollow cylinder segments 17, 18, 19 and also the pressure means 14, 16 are created in such a way that they form two steps 32, 33 extending in the shape of a ring. It can furthermore be seen that the pressure means 14, 16 have projections 30, 31. These projections 30, 31 form a further step 34, which serves as a bearing surface for a column 21 with variable resistors. In this case, the bearing surface 34 is consequently formed by the projections 30, 31.

The invention claimed is:

1. A surge arrester, comprising:

a tubular housing having an end and an inner surface;

an end fitting connected to said end of said housing;

a column disposed on said end fitting, said column having at least one electrical resistor;

a support abutting said inner surface of said tubular housing in a region of said end fitting, said support being a substantially hollow cylinder having a recess completely severing said support or said support being a plurality of hollow cylinder segments forming a plurality of recesses therebetween in an installed state, said recess or said recesses being formed in a longitudinal direction of the surge arrester; and a wedge-shaped pressure device inserted in said recess or a plurality of wedge-shaped pressure devices each inserted in a respective one of said plurality of recesses and configured to be displaced in a longitudinal direction of said tubular housing for spreading open and pressing said support against said inner surface of said tubular housing.

2. The surge arrester according to claim 1, wherein said pressure device is form-lockingly disposed in said recess or said pressure devices are form-lockingly disposed in said recesses.

3. The surge arrester according to claim 1, wherein:

said recess or each of said recesses has two contact regions contacting said pressure device or pressure devices;

said contact regions each have a guide groove;

said pressure device or pressure devices has sides facing said contact regions and a respective guide projection on each of said sides; and said guide projections are disposed in said guide grooves.

4. The surge arrester according to claim 3, wherein said guide grooves and said guide projections fix said pressure device or pressure devices on said support and produce a cylinder-barrel-shaped outer contour of said pressure device or pressure devices and said support being pressed against said inner surface of said tubular housing without damage.

5. The surge arrester according to claim 1, wherein said support forms a ring-shaped step in which said column is form-lockingly received.

6. A method for installing a surge arrester, the method comprising:

providing a tubular housing having an end and an inner surface;

connecting an end fitting to the end of the housing;

placing a column having at least one electrical resistor on the end fitting;

abutting a support against the inner surface of the tubular housing in a region of the end fitting, the support being a substantially hollow cylinder having a recess completely severing the support or the support being a plurality of hollow cylinder segments forming a plurality of recesses therebetween in an installed state, the recess or the recesses being formed in a longitudinal direction of the surge arrester;

inserting a wedge-shaped pressure device in the recess or inserting one of a plurality of wedge-shaped pressure devices in each respective one of the plurality of recesses; and displacing the pressure device or pressure devices in a longitudinal direction of the tubular housing for spreading open and pressing the support against the inner surface of the tubular housing.

7. The method according to claim 6, which further comprises placing the pressure device or pressure devices form-lockingly in the recess or recesses.

8. The method according to claim 6, which further comprises:

providing the support with two contact regions contacting the pressure device or pressure devices;

providing each of the contact regions with a guide groove;

providing the pressure device or pressure devices with respective guide projections on sides facing the contact regions of the support; and inserting the guide projections into the guide grooves.

9. The method according to claim 8, which further comprises using the guide grooves and the guide projections to fix the pressure device or pressure devices on the support and produce a cylinder-barrel-shaped outer contour of the pressure device or pressure devices and the support being pressed against the inner surface of the tubular housing without damage.

10. The method according to claim 6, which further comprises using the support to form a ring-shaped step in which a column having at least one electrical resistor is form-lockingly received.

* * * * *